US005269042A

United States Patent [19]

Stephens et al.

[11] Patent Number: 5,269,042

[45] Date of Patent: Dec. 14, 1993

[54] HEIGHT ADJUSTMENT SYSTEM FOR VACUUM CLEANER

[75] Inventors: Paul D. Stephens, Cleveland Heights; Michael F. Wright, Cuyahoga Falls, both of Ohio

[73] Assignee: Royal Appliance Mfg. Co., Cleveland, Ohio

[21] Appl. No.: 819,266

[22] Filed: Jan. 10, 1992

[51] Int. Cl.[5] ..... A47L 5/34

[52] U.S. Cl. ..... 15/356; 15/333; 15/361

[58] Field of Search ..... 15/333, 354, 356, 359, 15/361

[56] References Cited

U.S. PATENT DOCUMENTS

| | | | |
|---|---|---|---|
| 2,107,016 | 2/1938 | Snyder | 15/354 X |
| 2,734,219 | 2/1956 | Kaufman | 15/361 |
| 2,763,887 | 9/1956 | Brace | 15/361 |
| 3,262,147 | 7/1966 | Waters et al. | 15/354 |
| 3,579,699 | 5/1971 | Blazer | 15/361 |
| 3,678,524 | 7/1972 | Nise et al. | 15/354 X |
| 3,683,448 | 8/1972 | Lagerstrom et al. | 15/354 |
| 3,848,292 | 11/1974 | Nordeen et al. | 15/354 X |
| 4,171,554 | 10/1979 | Tschudy | 15/359 |
| 4,391,018 | 7/1983 | Vermillion et al. | 15/354 X |
| 4,446,594 | 5/1984 | Watanabe et al. | 15/361 X |
| 4,823,429 | 4/1989 | Petralia | 15/333 |
| 5,042,109 | 8/1991 | Stephens | 15/354 |
| 5,134,750 | 8/1992 | King et al. | 15/356 X |

*Primary Examiner*—Stephen F. Gerrity

*Attorney, Agent, or Firm*—Fay, Sharpe, Beall, Fagan, Minnich & McKee

[57] ABSTRACT

A height adjustment system for an upright vacuum cleaner comprises a cam member with a cam surface. The cam member is mounted within a base and includes rollers which facilitate the sliding lateral movement of the cam member within the base. The rollers roll within a channel within the base. Notches are formed in the side walls of the channel and receive a resiliently deformable indexing member which locates and fixes a cam follower at discrete points along the cam surface. A secondary height adjustment system comprises a ledge located on a housing which is attached to a handle. When the handle of the vacuum cleaner is rotated from a use position to an upright locked position, the ledge on the housing displaces a finger which pushes against a fulcrum plate attached to an axle connected to the front wheels of the vacuum cleaner. When the axle is so displaced, the front wheels swing downwardly, thereby raising the rotating brush above the floor surface so that the floor surface to be cleaned is not damaged while the vacuum remains stationary.

26 Claims, 5 Drawing Sheets

HEIGHT ADJUSTMENT SYSTEM FOR VACUUM CLEANER

BACKGROUND OF THE INVENTION

I. Field of the Invention

This invention relates to appliances used for floor cleaning, and more specifically to a height adjustment means for adjusting the height of a vacuum cleaner suction inlet and rotating brush relative to a floor surface to be cleaned.

II. Description of the Related Art

Vacuum cleaners come in many styles, one of which is an upright type vacuum cleaner which includes a generally vertically extending handle which is used to propel the vacuum cleaner over the surface to be cleaned. A rotating brush is often mounted within the housing of the vacuum cleaner. The brush is rotated by the vacuum cleaner motor to agitate the floor surface and loosen dirt so that it may be sucked into the dirt bag of the vacuum cleaner. The base of the vacuum is typically supported by wheels. A vacuum cleaner is typically used to clean carpet. Since carpet comes in many different styles and heights, a vacuum cleaner suction inlet is ideally placed at the optimum height to clean the particular carpet involved. Many types of suction inlet adjustment mechanisms are known in the art. For example, U.S. Pat. No. 3,848,292 to Nordeen, et al. discloses an upright style vacuum cleaner with an adjustment means. Similarly, U.S. Pat. No. 3,683,448 to Lagerstrom, et al. discloses an upright vacuum cleaner with a height adjustment mechanism utilizing a cam surface. The adjusting member for the cam is located on an upper front surface of the body for manipulation by a user. Finally, U.S. Pat. No. 4,391,018 to Vermillion, et al. discloses an upright vacuum cleaner having a nozzle height adjustment mechanism involving axles and levers.

The prior art features devices which are often complex and therefore costly. The present invention is an inexpensive yet effective mechanism which conveniently adjusts the height of the suction inlet relative to the surface to be cleaned. As such, the present invention contemplates a new and improved vacuum cleaner height adjustment system which is simple in design, effective in use, and overcomes the foregoing difficulties and others while providing better and more advantageous overall results.

SUMMARY OF THE INVENTION

In accordance with the present invention, a new and improved vacuum cleaner height adjustment system is provided.

More particularly, in accordance with the invention, the inventive vacuum cleaner comprises a base having an upper surface and a suction inlet. The vacuum cleaner also has front wheels which are rotatably attached to the base and are selectively swingable downwardly to selectively raise the front surface of the base, and thereby the suction inlet. A handle is pivotably attached to the base and is selectively swingable from an upright position to an angled use position. The use position is suitable for a user to propel the vacuum cleaner over an associated floor surface. The upright position is suitable for locking the handle in the upright position when the vacuum cleaner is stationary. A rotating brush is rotatably fixed to the base near the front surface of the base. The suction inlet and the rotating brush are movable between first and second positions. In the first position, the rotating brush contacts the floor surface. In the second position, the rotating brush is elevated above the floor surface so that it essentially does not contact the floor surface while rotating. Elevating means for elevating the front surface and the rotating brush from the first position to the second position are actuated by movement of the handle from the use position to the upright position. The elevating means comprises a finger which is mounted within the base and which has first and second ends. The second end of the finger is connected to and selectively displaces the front wheels and swings them downwardly to the second position.

According to another aspect of the invention, the vacuum cleaner further comprises an arcuate axle. The arcuate axle has front wheels rotatably attached to each of its first and second ends. The second end of the finger selectively swings the front wheels downwardly to the second position.

According to another aspect of the invention, a vacuum cleaner comprises a base which has front, side, upper, and back surfaces. Wheels are rotatably attached to the base and are selectively swingable downwardly to raise the front surface of the base. A rotating brush is affixed to the base near its front surface. The rotating brush is displaceable between first and second positions. The rotating brush has a certain elevation in the first position and a different elevation over the floor surface in the second position. Adjusting means for adjusting the height of the rotating brush from the first position to the second position comprises a cam member and a cam follower. The cam follower is connected to the wheels. The cam member is mounted within the base and has a cam surface and rollers. The rollers contact the base and enable the cam member to slide easily across the base. The cam surface cooperates with the cam follower to adjust the height of the rotating brush.

According to another aspect of the invention, the base further comprises first and second side walls on the upper surface of the base. The first and second side walls create a channel and a floor therebetween. The floor has a slot therein. The first side wall has a plurality of notches therein. Likewise, the second side wall has a plurality of notches, the number of notches in the first side wall differing from the number of notches in the second side wall. The notches selectively receive an indexing means which is mounted on the cam member and comprises a resiliently deformable extension.

One advantage of the present invention is the provision of a new and improved height adjustment mechanism which can be used to adjust the height of a rotating brush and suction nozzle to an optimum height over a surface to be cleaned.

Another advantage of the invention is the provision of a cam member which can be utilized in two different vacuum cleaner models; one of the models utilizing a first number of height adjustment settings, while a second model might use a different number of height adjustment settings. The use of a single part lowers manufacturing costs.

Another advantage of the present invention is the ease of operability by the user. Due to the provision of rollers on the cam member, adjusting the height of the rotating brush and the suction inlet is easy.

Another advantage of the present invention is its low cost due to inexpensive plastic parts, snap together features, and the reduction or elimination of conventional fasteners.

Another advantage of the present invention is the provision of a cam surface and arcuate axle working together in tandem to easily adjust the height of the nozzle and rotating brush over the floor surface to be cleaned.

Yet further advantage of the present invention is the provision of a mechanism whereby the rotating brush may be elevated above the surface to be cleaned by simply locking the handle into the upright position.

Still other advantages of the present invention will become apparent to those skilled in the art to which it pertains after a reading and understanding of the following detailed specification.

BRIEF DESCRIPTION OF THE DRAWINGS

The invention may take physical form in certain parts and arrangement of parts, a preferred embodiment of which will be described in detail in the specification and illustrated in the accompanying drawings, which form a part hereof and wherein.

DESCRIPTION OF THE PREFERRED EMBODIMENT

Figure 1:
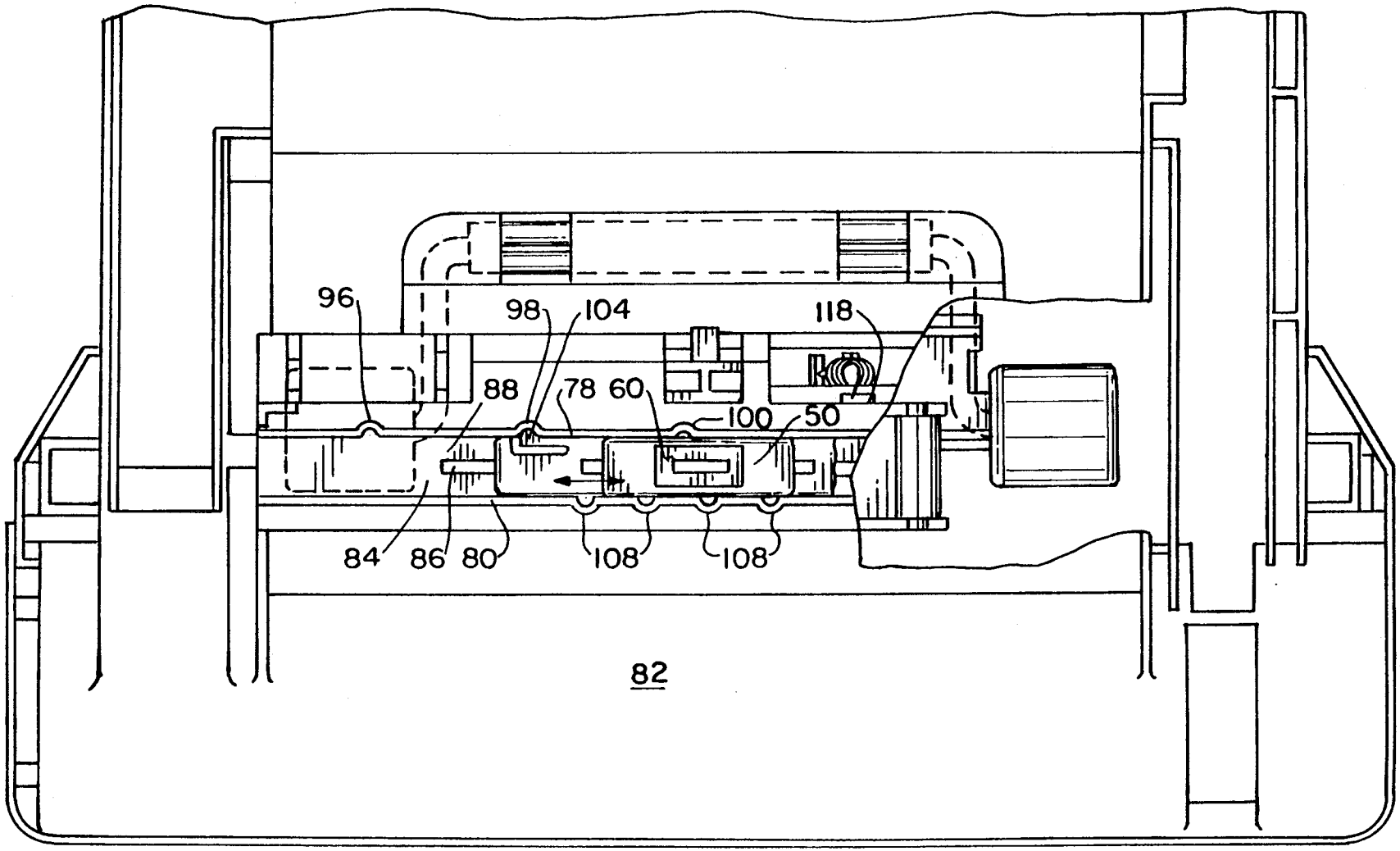
FIG. 1 is a top plan view, with certain parts broken away for clarity, of a vacuum cleaner having a height adjustment mechanism according to the invention.
Figure 2:
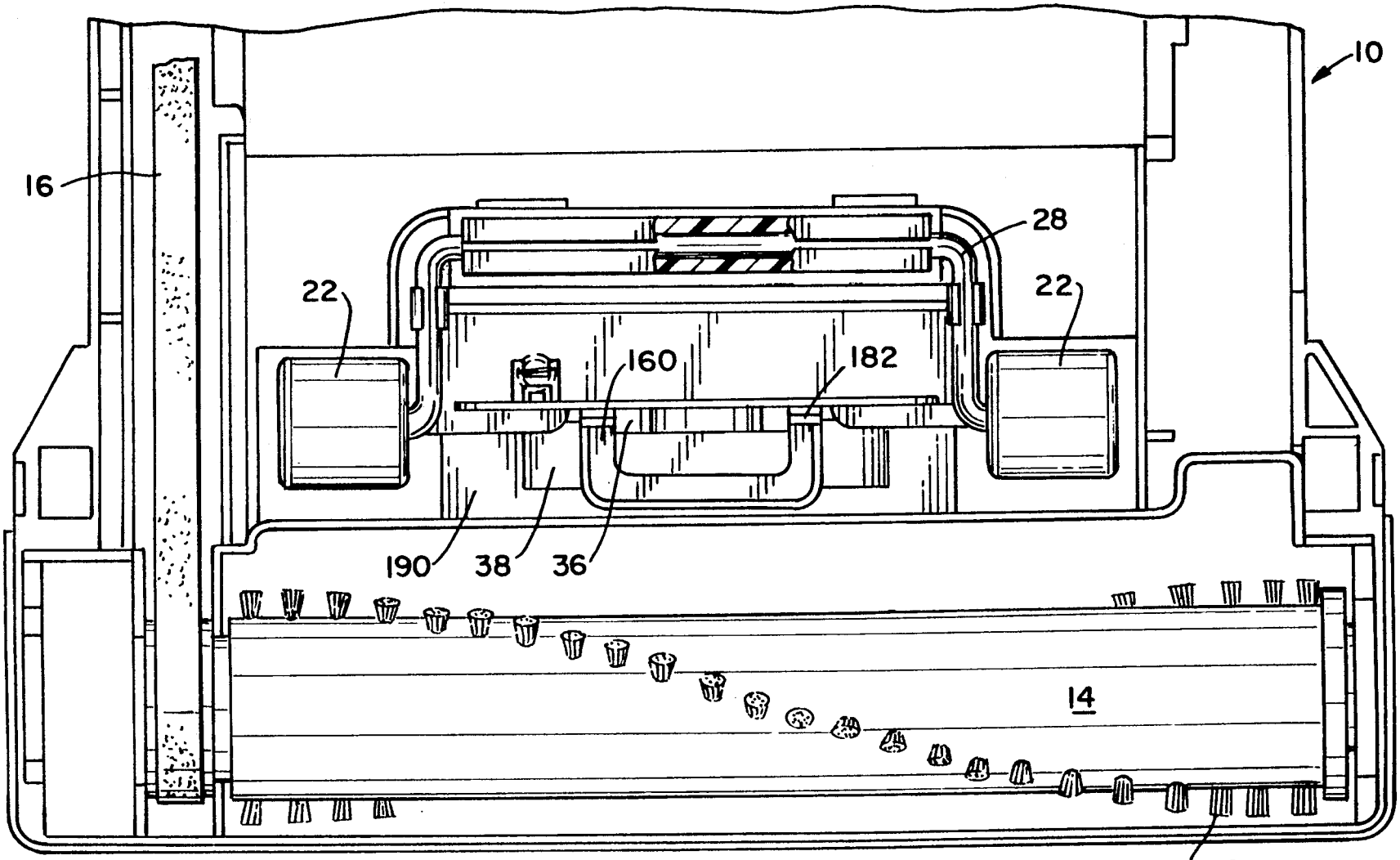
FIG. 2 is a bottom plan view of a vacuum cleaner having a height adjustment mechanism according to the invention.

Referring now to the drawings, wherein the showings are for purposes of illustrating a preferred embodiment of the invention only and not for purposes of limiting the same, FIGS. 1-4 show a vacuum cleaner with a height adjustment system according to the invention. The vacuum cleaner 10 has a base 12. The base 12 is a housing which contains many of the components of the vacuum cleaner 10. With particular reference to FIG. 2, a rotating brush 14 is driven by a belt 16, which in turn is attached to a motor (not shown). The rotating brush 14 has bristles 18 which agitate the floor surface and dislodge dirt which can then be sucked into the suction inlet 20 and retained within a dust bag (not shown) within the vacuum cleaner 10.

The base 12 is supported in part by front wheels 22. One of the front wheels 22 is attached to each end of an arcuate axle 28.

Attached to the arcuate axle 28 is cam follower 30. As can be seen most clearly in FIG. 3, the cam follower 30 attaches to the arcuate axle 28 via a press fit between the axle 28 and resiliently deformable clips 34. During assembly, the clips 34 are forced downwardly onto the axle 28 until the clips 34 deform enough to grip the axle 28 within the clips 34. The cam follower 30 also comprises a follower frame 35 and a follower point 36. The follower point 36 contacts a cam surface 38 on the cam member 40. In the preferred embodiment, the follower point 36 is rounded into a semi-circular shape.

The cam member 40 has two side walls 42, a cam member floor 37, and a center projection 44. The cam member floor 37 has a lower surface which is a cam surface 38. Rollers 46 are rotatably mounted between the side walls 42. The rollers 46 extend slightly above the top surface 48 of the cam member 40.

The center projection 44 is attached to the cam member floor 37 and extends upwardly from it. The center projection 44 is received within a cam lever 50. The cam lever 50 has an outer surface 52 and an inner surface 54. The upper portion of cam lever 50 comprises a bore 56. The bore receives a handle 60.

A wall 64 extends downwardly from the inner surface 54 of cam lever 50. The wall 64 rests on ledge 67. Slots 66, 68 in upper surface 70 of the center projection 44 weaken the structural integrity of the center projection 44, facilitating the elastic inward deformation of the side wedges 72 when the center projection 44 is assembled to the cam lever 50. Side wedges 72 in the center projection 44 deform inwardly to fit into slots 74 in the cam lever to attach the cam member 40 to the cam lever 50.

With particular reference to FIG. 1, a top plan view of a vacuum cleaner 10 with the preferred height adjustment system is shown. Two side walls 78, 80 in an upper surface 82 of said base 12 form a channel 84 therebetween. The cam lever 50 slides within the channel 84. The handle 60 extends upwardly above the upper surface 82 of the base 12 and is easily grasped by the hand of the user of the vacuum cleaner 10. By sliding the handle 60 to the left or to the right, the height adjustment system is operated.

Figure 3:
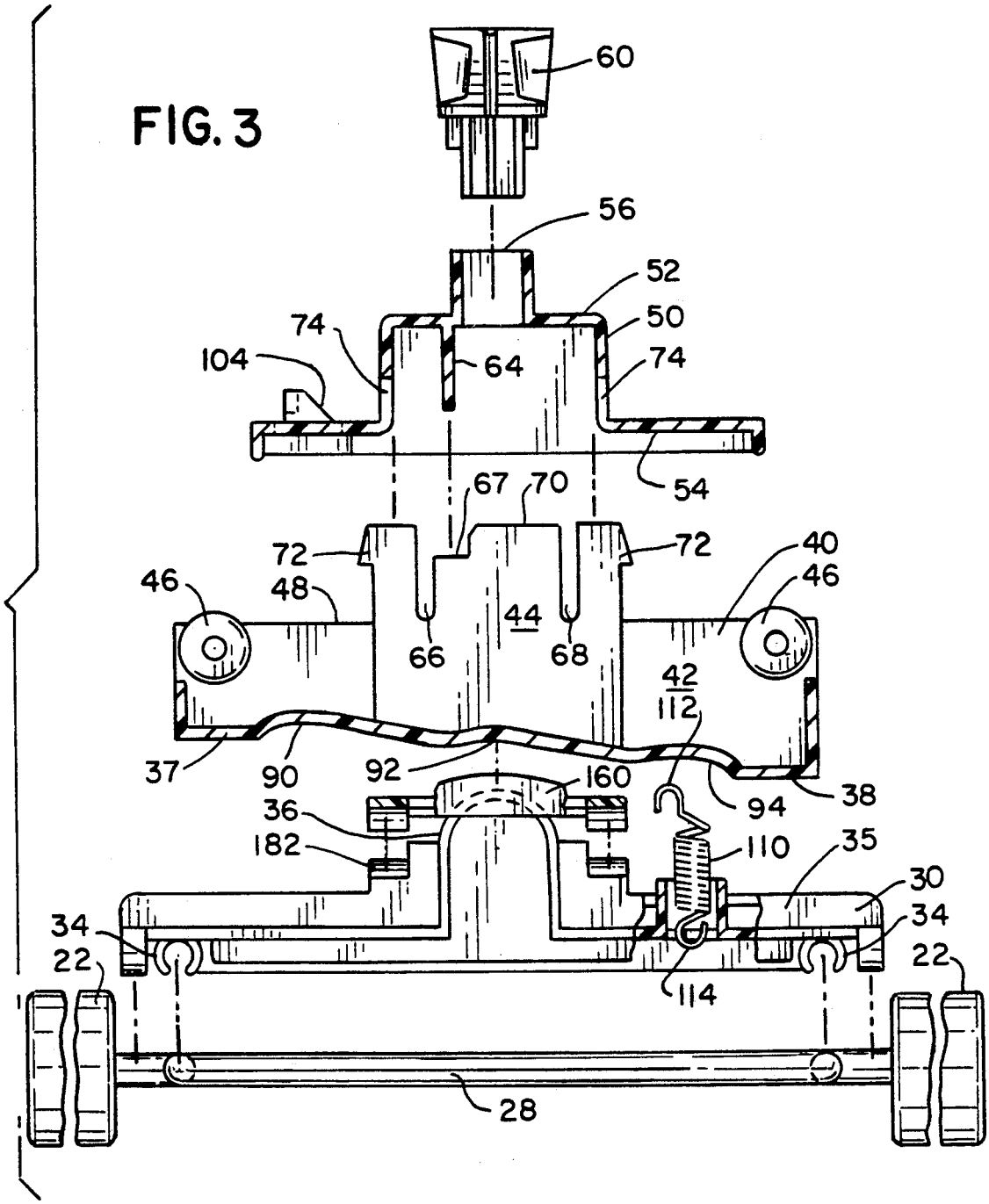
FIG. 3 is an exploded perspective view of a cam lever, cam member, cam follower, arcuate axle, and front wheels according to the invention.

With continuing reference to FIG. 1, a slot 86 is located in the floor 88 of the channel 84. With continuing reference to FIG. 1 and FIG. 3, the cam lever 50 is manufactured as a separate piece from the cam member 40 in order for the upper surface 82 of the base 12 to fit between the cam lever 50 and the cam member 40. During assembly of the vacuum cleaner 10, the center projection 44 of the cam member 40 is inserted through the slot 86 of the base 12. When the center projection 44 is extending upwardly through the slot 86, the cam lever 50 can be pushed down onto the center projection 44, and the side wedges 72 snap into place within the slots 74. Wall 64 rests on ledge 67.

With continuing reference to FIG. 1 and FIG. 3, the cam surface 38 features three dwell points 90, 92, 94. The dwell points 90, 92, 94 correspond to notches 96, 98, 100 which are placed in the first side wall 78. An indexing means is mounted on the cam lever 50 to lock the height adjustment mechanism into discrete locations along the cam surface 38. In the preferred embodiment, the indexing means comprises a resiliently deformable extension 104. The extension 104 is preferably made of plastic and deforms inwardly toward the center of the channel 84 when the cam lever 50 is moved within the channel 84. When the extension 104 is opposite one of the notches 96, 98, 100, it snaps outwardly into the notch and retains the cam lever 50 in that position unless overcome by greater lateral force exerted on the handle 60 by the user.

In the preferred embodiment, the second side wall 80 also has notches 108. The number of notches 108 in the second side wall 80 is different than the number of notches 96,98,100 in the first side wall 78. This configuration allows the same cam lever 50 to be utilized with different cam members 40. For example, in the embodiment shown in FIG. 3, the cam surface 38 has three dwell points 90, 92, 94. Correspondingly, the first side wall 78 has three notches 96, 98, 100. However, should the manufacturer desire a cam surface having some number other than three height adjustment settings, during assembly the cam lever 50 could be rotated 180° so that the extension 104 is now on the right side of FIG. 3, rather than the left side. The extension 104 could then cooperate with the notches 108 in the second side wall 80. Correspondingly, a new cam member 40 having a differently shaped cam surface 38 could be used with the same cam lever 50.

The new cam member 40 would have ledge 67 on the opposite side, since cam lever 50 has been rotated 180°.

A spring 110 has first end 112 and second end 114. The first end 112 of the spring 110 is attached to the upper surface 82 of the base 12 at a slot 118. Similarly, the second end 114 of the spring 110 is attached to a hole in the cam follower 30, as is most clearly seen in FIG. 3. The spring 110 biases the cam follower 30, and specifically the follower point 36, against the cam surface 38.

The rollers 46 roll against the bottom surface of the channel 84 and contribute greatly to the ease of operation of the height adjustment means by lowering the effort required to slide the cam lever 50 and cam member 40 laterally within the base 12. When the user grips the handle 60 and translates it laterally to the right or the left, the force is transmitted through the handle 60 to the cam lever 50 and to the cam member 40. The cam lever 50 and cam member 40 translate relative to the base 12., causing the follower point 36 to locate a different dwell point 90, 92, 94 along the cam surface 38. Due to the inclined nature of the cam surface 38 (see FIG. 3), the cam follower 30 is displaced upwardly or downwardly.

Such displacement causes the arcuate axle 28 to pivot between a first position and a second position. The first position corresponds to dwell point 90 on the cam surface 38. When the cam follower 30 is translated so that the follower point 36 now rests at dwell point 92, the front wheels 22 have been displaced from the first position to the second position and the front of the base 12, including the rotating brush 14 and suction inlet 20, have been elevated relative to the floor surface. This process can be repeated to move the suction inlet 20 to a third or fourth position in the same manner.

Figure 5:
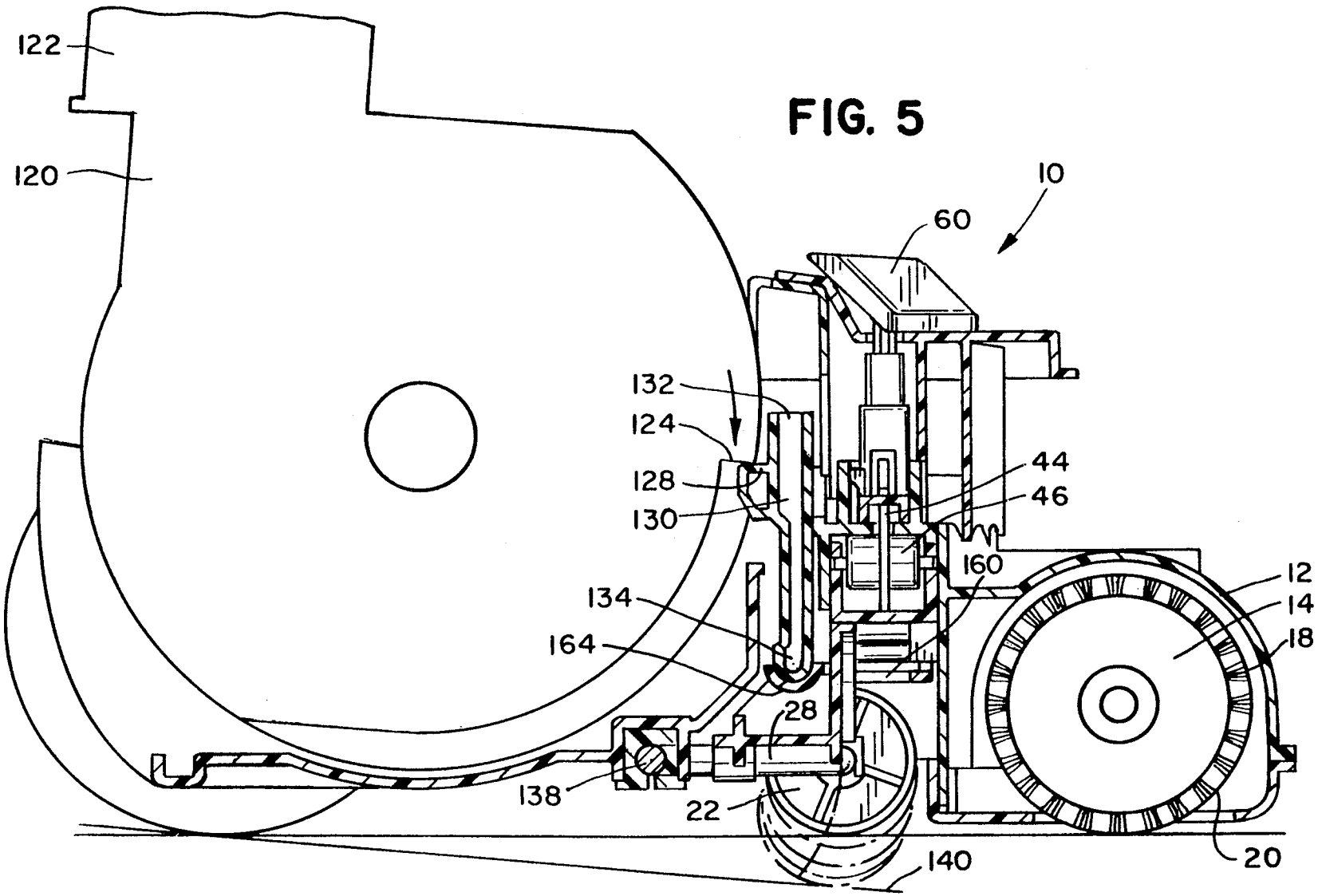
FIG. 5 is a side elevational view in cross section of a vacuum cleaner having a height adjustment mechanism according to the invention.

With reference to FIG. 5, another height adjusting feature of the invention will be explained. Some upright vacuum cleaners feature an auxiliary hose which can be used for off-the-floor cleaning such as drapes and upholstered furniture. It is desirable to raise the rotating brush 14 so that the carpet is not damaged while the vacuum cleaner 10 remains stationary and the above-the-floor cleaning is done. Otherwise, the carpet could conceivably be damaged by the repeated action of the rotating brush 14.

A housing 120 is attached to and is pivotable with the handle 122 of the vacuum cleaner 10. The housing 120 features a first ledge 124. The first ledge 124 selectively contacts a second ledge 128 which is attached to a first end 132 of a finger 130. The rotation of the first ledge 124 into the second ledge 128 causes a second end 134 of the finger 130 to displace a first opposite edge 162 of a fulcrum plate 160. The second end 134 of the finger 130 fits into a semi-cylindrical recess 164 and is retained there by pins 166.

The fulcrum plate 160 also has a second opposite edge 168 with a center void 170 therebetween. The follower point 36 of the cam follower 30 extends upwardly through the center void 170. An arch 174 extends upwardly from a top surface 176 of the fulcrum plate 160 and adjacent the second opposite edge 168.

An attaching means for attaching the fulcrum plate 160 to the associated vacuum cleaner 10 is attached to a bottom surface 178 of the fulcrum plate 160. In the preferred embodiment, the attaching means comprises clips 180 which elastically deform about and grip a rod-like part 182 of the cam follower 30.

When the second end 134 of the finger 130 displaces the first opposite edge 162 of the fulcrum plate 160 downwardly, the second opposite edge 168 pivots upwardly. The clips 180 rotate about rod like part 182. This movement raises the arch 174 which is along the second opposite edge 168 of the fulcrum plate 160.

Figure 4:
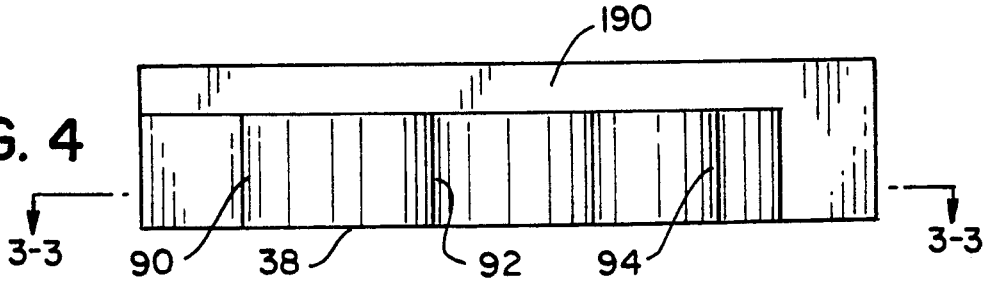
FIG. 4 is a bottom plan view of the cam surface of the earn member.
Figure 3A:
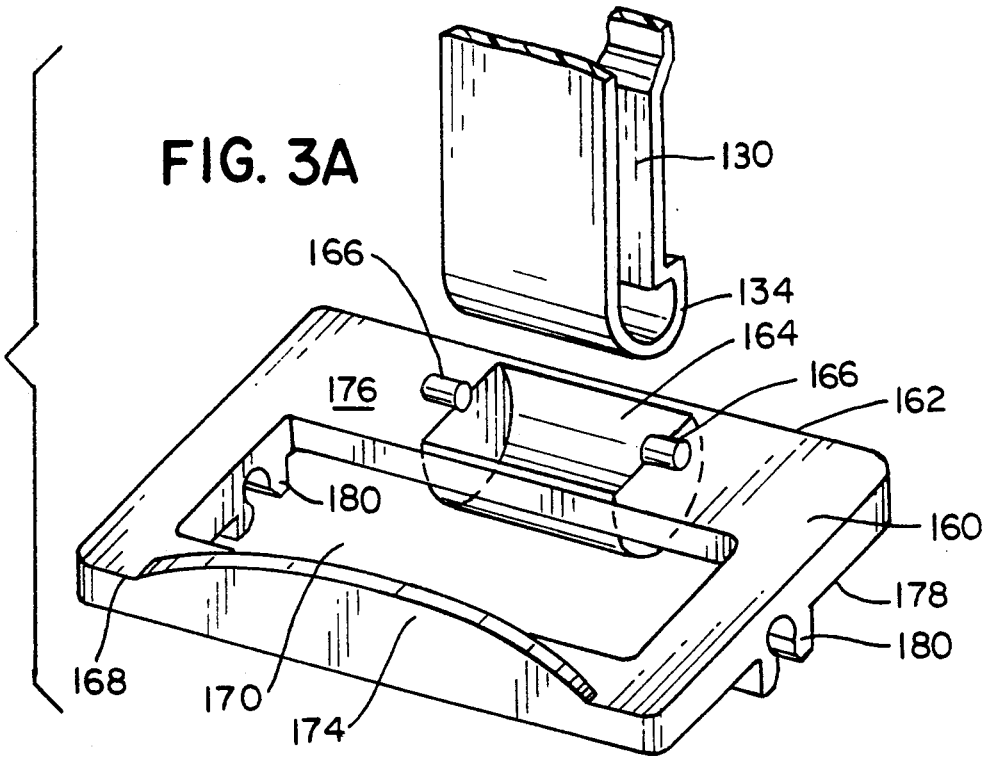
FIG. 3A is a perspective exploded view of a fulcrum plate and second end of a finger according to the invention.
Figure 3B:
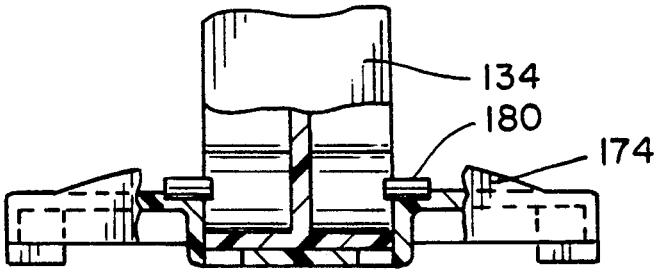
FIG. 3B is a front view, partially broken away, of a fulcrum plate and finger according to the invention.
Figure 3C:
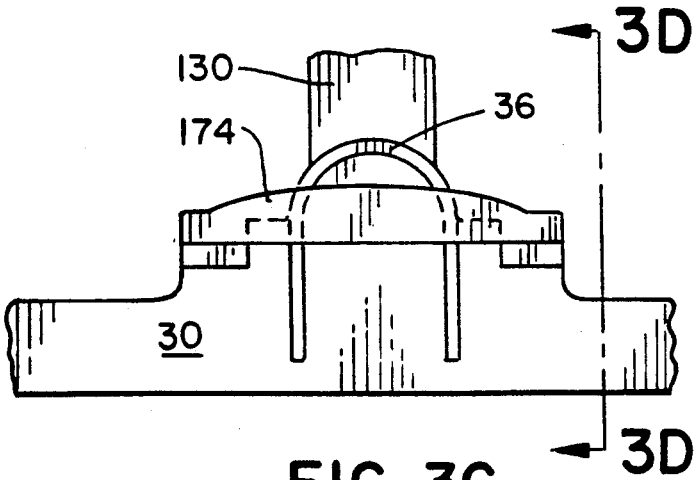
FIG. 3C is a front view of a fulcrum plate and finger according to the invention.
Figure 3D:
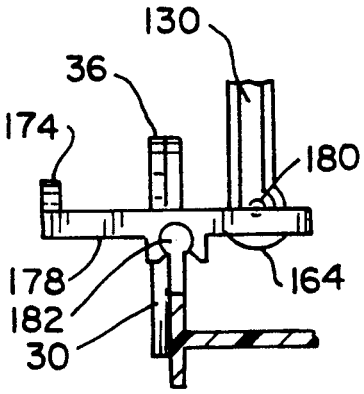
FIG. 3D is a side view, partially in cross-section, taken along line 3D—3D of FIG. 3C, of a fulcrum plate according to the invention.

The arch 174 pushes upwardly against a flat surface 190 of cam surface 38. The flat surface 190 is seen in FIG. 4 but not in FIG. 3, due to location of section line 3—3. This upward movement by the arch 174 causes relative downward movement by the rod-like part 182, therefore the cam follower 30, and the axle 28.

Such movement rotates the arcuate axle 28 about its axis 138 and swings the front wheels downwardly from the first position as shown in FIG. 5 to a second position indicated by line 140. As the handle 122 locks into place in the upright position, the rotation of the first ledge 124 into the second ledge 128 as described causes the front wheels 22 to swing to the second position, as indicated by line 140, and raises the rotating brush 14 relative to the floor surface. In the raised position, the bristles 18 are less likely to damage the carpet fibers, even if the vacuum cleaner 10 is allowed to remain in that position for extended periods of time.

The invention has been described with reference to a preferred embodiment. Obviously, modifications and alterations will occur to those upon a reading and understanding of the specification. It is intended to include all such modifications and alterations insofar as they come within the scope of the appended claims or the equivalents thereof.

Having thus described the invention, it is now claimed;

1. A vacuum cleaner comprising:

a base having a suction inlet;

a front wheel, said front wheel rotatably attached to an axle, said axle being secured to said base and being selectively swingable downwardly to selectively raise said suction inlet of said base from a use position on a subjacent floor surface to a non-use position;

a handle pivotably attached to said base, said handle selectively swingable to an upright non-use position or an angled use position, said use position suitable for a user to propel said vacuum cleaner over the floor surface and said upright non-use position being employed when said vacuum cleaner is stationary;

a rotating brush rotatably affixed to said base adjacent said suction inlet, said rotating brush contacting said floor surface in said use position of said suction inlet;

elevating means for elevating said suction inlet from said use position to said non-use position upon movement of said handle from said angled use position to said upright non-use position, wherein in said non-use position said suction inlet is raised above said floor surface so that the rotating brush generally does not contact said floor surface, said elevating means comprising a finger movably positioned in said base and operatively contacting said axle, said finger having first and second ends; and, a fulcrum plate having a first edge and a second edge, said fulcrum plate operatively connected to said axle, said second end of said finger connected to said first edge of said fulcrum plate, downward movement of said finger causing said first edge of said fulcrum plate to move downwardly, thereby raising said second edge of said fulcrum plate, said second edge of said fulcrum plate contacting said base near said suction inlet and rotating brush, said downward movement by said finger moving said axle downwardly thereby raising said suction inlet to said non-use position.

2. The vacuum cleaner of claim 1 wherein said elevating means for elevating further comprises:

a first housing attached to said handle and pivotable therewith, said first housing having a first ledge, said first end of said finger selectively contactable and displaceable by said first ledge of said first housing, said second end of said finger selectively displacing said axle downwardly to place said suction inlet into said non-use position when said first end of said finger is displaced by said first ledge.

3. The vacuum cleaner of claim 1 wherein two front wheels are provided on said axle and wherein said axle comprises an arcuate member having first and second ends, one of said front wheels being rotatably attached to said first end of said axle and said other front wheel being rotatably attached to said second end of said axle, said second end of said finger selectively translating downward and swinging said front wheels downwardly thereby raising said suction inlet to said non-use position.

4. A vacuum cleaner comprising:

a base having a suction inlet;

wheels, said wheels rotatably attached to said base for supporting said base on a subjacent support surface in a use position of said suction inlet, said wheels being selectively swingable downwardly in relation to said base to raise said suction inlet from the support surface to a non-use position;

a rotating brush affixed to said base adjacent said suction inlet, said rotating brush having a certain elevation above the support surface in said use position of said suction inlet and a different elevation in said non-use position of said suction inlet; and, adjusting means for adjusting the height of said suction inlet from said use position to said non-use position, said adjusting means comprising a cam member and a cam follower, said cam follower connected to said wheels, said cam member mounted within said base and having a cam surface and rollers, said rollers rotatably contacting said base thereby reducing friction between said base and said cam surface and enabling said cam member to slide easily across said base, said cam surface cooperating with said cam follower to adjust the height of said suction inlet.

5. The vacuum cleaner of claim 4 wherein said adjusting means further comprises a cam lever and said base further comprises:

first and second side walls on an upper surface of said base, said first and second side walls forming a channel having a channel floor, said cam lever being located in said channel, said channel floor having a slot therein through which a portion of said cam member extends.

6. The vacuum cleaner of claim 5 wherein said first side wall has a notch therein for selectively accommodating a portion of said cam lever.

7. The vacuum cleaner of claim 6 wherein said portion of said cam lever comprises indexing means, said indexing means being selectively received within said notch to register the position of said cam lever and hence said cam member relative to said channel.

8. The vacuum cleaner of claim 7 wherein said indexing means comprises an elastically deformable extension which selectively snaps into said notch to register the position of said cam member relative to said first slot.

9. The vacuum cleaner of claim 5 wherein said first and second side walls have notches therein for selectively accommodating a portion of said cam lever, the number of notches in said first side wall differing from the number of notches in said second side wall.

10. A vacuum cleaner comprising:

a base having a suction inlet;

an axle attached to said base, said axle having first and second ends;

wheels rotatably attached to said ends of said axle;

adjusting means for adjusting the height of said suction inlet over an associated floor surface, said adjusting means comprising a cam member and a cam follower, said cam follower comprising;

a cam follower frame;

a cam follower point located on said cam follower frame, said cam follower point contacting a cam surface of said cam member;

biasing means for biasing said cam follower point against said cam surface; and, attaching means for attaching said cam follower frame to said axle wherein said attaching means for attaching said cam follower frame to said axle comprises a clip, said clip being resiliently deformable about said axle and attaching said cam follower thereto.

11. The vacuum cleaner of claim 10 wherein said cam follower point is generally semi-circular.

12. The vacuum cleaner of claim 10 wherein said biasing means is a spring having first and second ends, said first end of said spring being attached to said cam follower frame and said second end of said spring being attached to said base.

13. A vacuum cleaner comprising:

a base having a suction inlet;

a wheel axle attached to said base, said wheel axle having first and second ends;

wheels rotatably attached to said ends of said wheel axle for supporting said base on a subjacent surface;

adjusting means for adjusting the height of said suction inlet over an associated floor surface, said adjusting means comprising a cam member, said cam member comprising;

a housing, said housing comprising first and second side walls and a bottom wall, said bottom wall extending between said side walls, said bottom wall having an upper surface and a lower surface, said lower surface being a cam surface which cooperates with an associated cam follower;

a first roller axle, said first roller axle mounted and extending between said first and second housing side walls; and a first roller contacting said base and allowing said cam member to slide in relation to said base, said first roller being rotatably mounted on said first roller axle.

14. The vacuum cleaner of claim 13 further comprising:

a second roller axle, said second roller axle mounted and extending between said first and second housing side walls, said first roller axle mounted near a first end of said side walls and said second roller axle mounted near a second end of said side walls; and, a second roller contacting said base and allowing said cam member to slide in relation to said base, said second roller mounted on said second roller axle.

15. The vacuum cleaner of claim 13 wherein said adjusting means further comprises:

a cam lever; and, said cam member further comprises a center projection, said center projection having top, bottom, and first and second side surfaces, said bottom surface of said center projection being attached to said bottom wall of said cam member housing and cooperating with said cam lever.

16. The vacuum cleaner of claim 15 wherein said center projection further comprises:

a first wedge extending outwardly from said first side surface, said first wedge being received within a hole in said cam lever to attach said cam member to said cam lever.

17. The vacuum cleaner of claim 16 further comprising:

a slot in said top surface of said center projection, said slot weakening said center projection, thereby facilitating elastic deformation of said first wedge inwardly.

18. A vacuum cleaner comprising:

a base, said base comprising an upper surface and a lower surface on which is located a suction inlet, said upper surface having a channel defined by upwardly extending first and second side walls, said channel including a floor having a slot therein;

a rotating brush mounted in said base adjacent said suction inlet;

height adjustment means for adjusting the height of said suction inlet over an associated surface to be cleaned, said height adjustment means comprising;

a cam member, said cam member mounted within said base and comprising:

a housing, said housing comprising third and fourth side walls and a second floor, said floor extending between said third and fourth side walls, said floor having an upper and lower surface, said lower surface being a cam surface;

a center projection, said center projection having top, bottom, and first and second side surfaces, said bottom surface of said center projection attached to said floor of said cam member housing, said top surface of said center projection extending up through said slot and into said channel of said base;

a cam follower, said cam follower comprising:

a cam follower frame, said cam follower frame mounted within said base; and, a cam follower point attached to said cam follower frame, said cam follower point contacting said cam surface of said cam member.

19. The vacuum cleaner of claim 18 further comprising:

an axle mounted between said third and fourth side walls of said cam member;

a roller rotatably mounted on said axle and contacting said base for allowing said cam member to be slid in relation to said base.

20. The vacuum cleaner of claim 18 wherein said cam member is selectively slidably within said channel, thereby adjusting the height of said suction inlet.

21. A vacuum cleaner comprising:

a base having a suction inlet;

a rotating brush, said rotating brush rotatably affixed to said base adjacent said suction inlet, said suction inlet and rotating brush being moveable between use and non-use positions, said rotating brush contacting and agitating an associated floor surface in said use position and being raised above said floor surface in said non-use position, so that in said non-use position said rotating brush generally does not contact said floor surface;

front wheels;

an axle, said front wheels rotatably attached to first and second ends of said axle, said axle being selectively swingable downwardly to raise said suction inlet of said base and said rotating brush from said use position to said non-use position;

a handle pivotably attached to said base, said handle selectively swingable to an upright non-use position or an angled use position, said handle use position suitable for a user to propel said vacuum cleaner over an associated floor surface and said handle upright position suitable for locking said handle in said upright position when said vacuum cleaner is stationary;

a first housing, said first housing attached to said handle and pivotable therewith, said first housing having a first ledge;

a finger, said finger movably mounted in said base and having first and second ends, said first end of said finger selectively contacting said first ledge of said first housing and being selectively displaceable downwardly thereby; and, a fulcrum plate located in said base, said fulcrum plate having first and second oppositely disposed edges and a fulcrum point therebetween, said second end of said finger attached to said first edge of said fulcrum plate and said second edge of said fulcrum plate contacting said base near said suction inlet and said rotating brush;

pivoting movement by said handle to said upright position causing rotation of said first ledge on said first housing to displace said finger downwardly, said second end of said finger displacing said first edge of said fulcrum plate and raising said second edge of said fulcrum plate, thereby swinging said axle downwardly to said non-use position and raising said suction inlet and rotating brush off said floor surface.

22. A vacuum cleaner comprising:

a base, said base having an upper surface and a lower surface with a suction inlet, said upper surface having side walls which define a channel, at least one of said side walls having notches;

a height adjustment means to raise a rotating brush located in said base adjacent said suction inlet to different heights over the surface to be cleaned, said height adjustment means comprising:

a cam follower operatively secured to said base;

a cam member mounted within said base, said cam member comprising:

a cam surface cooperating with said cam follower to raise said suction inlet to different heights;

and a center projection;

a cam lever positioned in said channel of said base, said cam lever having an inner surface and an outer surface, said center projection extending upwardly from said cam member into said channel through a slot in said channel, said cam lever receiving said center projection and being affixed thereto.

23. The vacuum cleaner of claim 22 wherein said cam member further comprises:

a pair of side walls; and, a roller, said roller being rotatably suspended between said side walls and cooperating with said base for allowing said cam member to be slid in relation to said base.

24. The vacuum cleaner of claim 22 wherein said cam member center projection comprises a top surface and side surfaces, said top surface including a ledge which cooperates with a downwardly extending wall of said cam lever.

25. The vacuum cleaner of claim 22 wherein said cam member center projection further comprises a wedge adjacent one of said side surfaces, said wedge cooperating with a slot in said cam lever to secure said cam member center projection to said cam lever.

26. The vacuum cleaner of claim 22 wherein said outer surface of said cam lever comprises a resiliently deformable extension which is selectively received by said notches in said side wall of said channel.

* * * * *